US005515629A

United States Patent [19]

Johansson

[11] Patent Number: 5,515,629

[45] Date of Patent: May 14, 1996

[54] POSTER FRAME AND METHOD FOR FRAMING A POSTER

[76] Inventor: Gert Johansson, Hammarsbacke 3B, Lerum, Sweden, S-443 38

[21] Appl. No.: 440,884

[22] Filed: May 15, 1995

Related U.S. Application Data

[63] Continuation of Ser. No. 126,234, Sep. 24, 1993, abandoned.

[51] Int. Cl.[6] ..... G09F 1/12

[52] U.S. Cl. ..... 40/745; 40/783; 40/594; 40/796

[58] Field of Search ..... 40/152, 152.1, 40/154, 155, 158.1, 594, 159; 248/488, 490, 551

[56] References Cited

U.S. PATENT DOCUMENTS

| | | | |
|---|---|---|---|
| 2,984,922 | 5/1961 | Ladenburger et al. | 40/158.1 X |
| 3,837,987 | 9/1974 | Williams et al. | 40/152.1 |
| 4,095,361 | 6/1978 | Ledenican | 40/152 |
| 4,630,386 | 12/1986 | Wilson | 40/155 |
| 4,636,105 | 1/1987 | Johannsson . | |
| 4,756,106 | 7/1988 | Foster | 40/594 X |
| 5,092,063 | 3/1992 | Shultz | 40/152 |
| 5,138,780 | 8/1992 | Kunkel | 40/152 |
| 5,187,886 | 2/1993 | Wu et al. | 40/152.1 |

*Primary Examiner*—Brian K. Green
*Attorney, Agent, or Firm*—Samuels, Gauthier & Stevens

[57] ABSTRACT

A frame for framing a poster or similar on a wall is disclosed. The frame requires no rigid backing element since the wall itself serves to support the poster. The frame includes a top piece, at least two side members and a plurality of corner pieces for connecting the top piece and the side members to form an enclosing frame. Each of the side members has a front portion and a rear portion, with these portions being connected together to form an inwardly facing groove for receiving edge portions of the poster. The rear portion is in the form of a thin flange having opposed front and rear surfaces with the front surface partially delimiting the groove.

9 Claims, 2 Drawing Sheets

POSTER FRAME AND METHOD FOR FRAMING A POSTER

This is a continuation of application Ser. No. 08/126,234 filed on Sep. 24, 1993, now abandoned.

TECHNICAL FIELD

The present invention relates to a frame for framing a poster or similar on a wall, the frame comprising a top piece, at least two side members and a plurality of corner pieces for connecting said top piece and said side members to thereby form an enclosing frame. The invention also relates to a method for framing a poster or similar in such a frame on a wall.

BACKGROUND OF THE INVENTION

A frame of the above-mentioned type is disclosed in U.S. Pat. No. 4,636,105 in the name of the present inventor. As shown in FIG. 1 of said document, the frame consists of a top arrangement and a plurality of side members. The top arrangement and side members are linked together by removable corner pieces to form an enclosing frame. The side members are each provided with a groove which is intended to receive edge portions of a rigid display sheet. The top arrangement presents a slot to allow the rigid display sheet to be slid into the grooves in the frame.

The above-described type of frame has proved to be very popular, not least because the corner pieces can be removed to thereby allow the frame to be disassembled for ease of storage and transportation. When assembled, the frame defines an opening in which, for example, a display sheet can be accommodated. The display sheet must be sufficiently rigid so that it will not flex to an extent where its edge portions come out of the grooves, otherwise the sheet could fall out of the frame. This need for a rigid sheet implies that, although the frame can be easily dismantled, the rigid sheet will always present a certain fixed surface area, thereby hindering transportation. When such a frame is used to display a poster, the poster must be supported by a rigid backing element, the edge portions of which are received in the grooves in the side members. Consequently, the frame and backing element are sold as a unit.

SUMMARY OF THE INVENTION

It is therefore an object of the present invention to provide a poster frame which takes up less storage space, is easier to transport in a disassembled state and is cheaper to produce than prior known frames.

This object is achieved in accordance with the present invention by means of a frame for framing a poster or similar on a wall, said frame comprising:

a) a top piece;

b) at least two side members;

c) a plurality of corner pieces for connecting said top piece and said side members to thereby form an enclosing frame;

wherein each of said side members presents a front portion and a rear portion, said front portion and said rear portion being connected together to form an inwardly facing groove therebetween for receiving edge portions of said poster, said rear portion consisting of a thin flange having opposed front and rear surfaces with said front surface partially delimiting said groove.

The present invention also provides a method for framing a poster or similar in a frame on a wall, said frame comprising a top piece, at least two side members, each of said at least two side members being provided with a groove for receiving edge portions of said poster, and a plurality of corner pieces for connecting said top piece and said side members to thereby form an enclosing frame, said method comprising:

mounting said enclosing frame on said wall using attachment means on said side members, and inserting said poster into said enclosing frame so that edge portions of said poster are received within said groove and remaining portions of said poster contact said wall to thereby provide support for said poster.

Since the frame according to the present invention makes use of the wall itself to which the frame is mounted to support the poster, no separate backing element is necessitated. This reduces the number of components making up the frame unit, thereby implying lower production and storage costs. In addition, the frame in its disassembled state is relatively easy to transport since the top piece, side members and corner pieces can be simply packaged in an elongated bag or similar.

Further advantages of the present invention will become apparent from the detailed description given hereinafter. However, it is to be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described in greater detail in the following by way of example only and with reference to the attached drawings, in which.

DETAILED DESCRIPTION OF PREFERRED EMBODIMENTS

Figure 1:
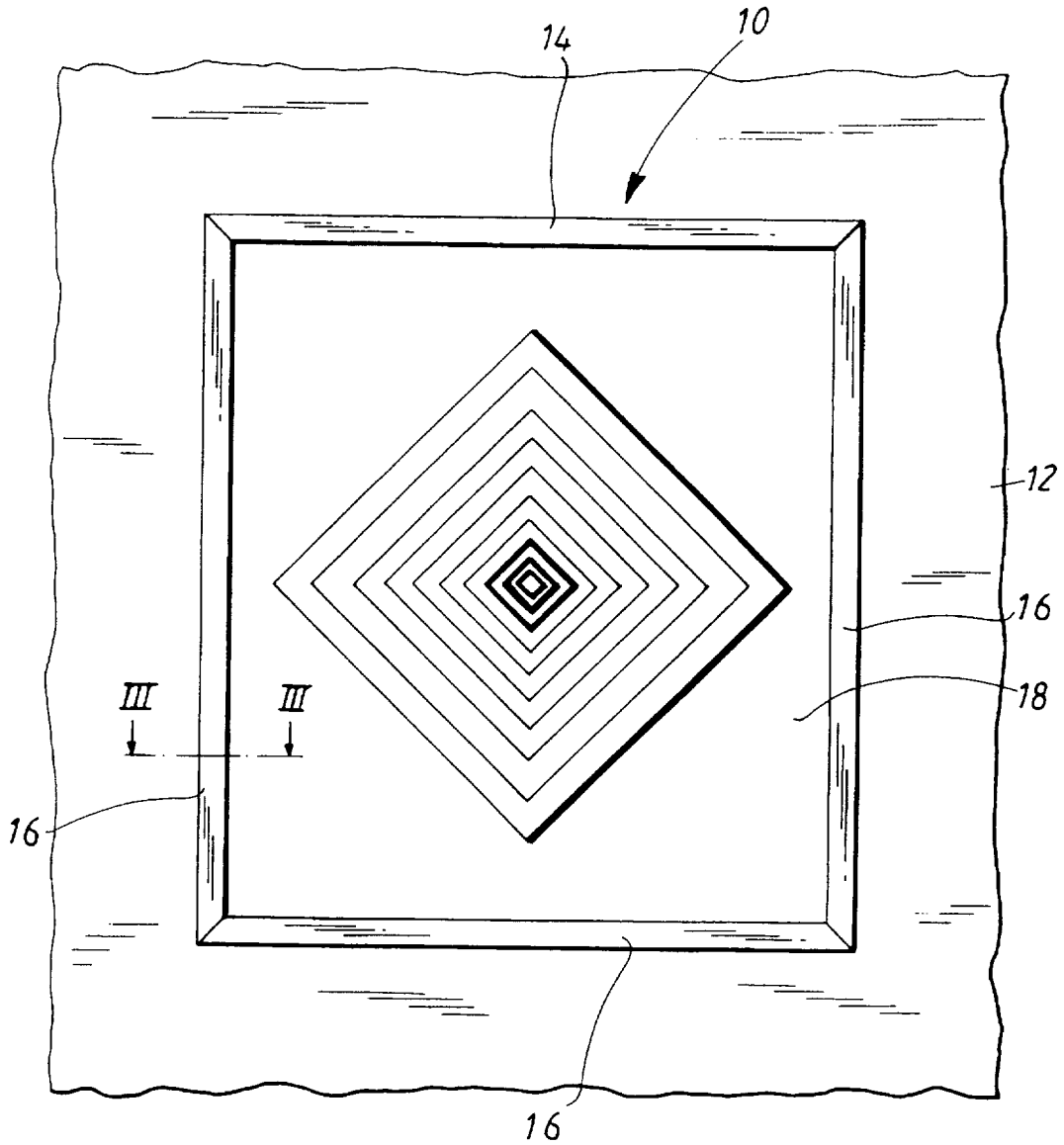
FIG. 1 shows a frame according to the present invention mounted on a wall.

In FIG. 1, reference numeral 10 generally denotes a frame in accordance with the present invention mounted to a portion of a wall 12. The frame comprises a top piece 14 and a plurality of (in the shown example three) side members 16. The top piece and side members are preferably made from an extruded plastics material. The frame displays a poster 18.

Figure 2:
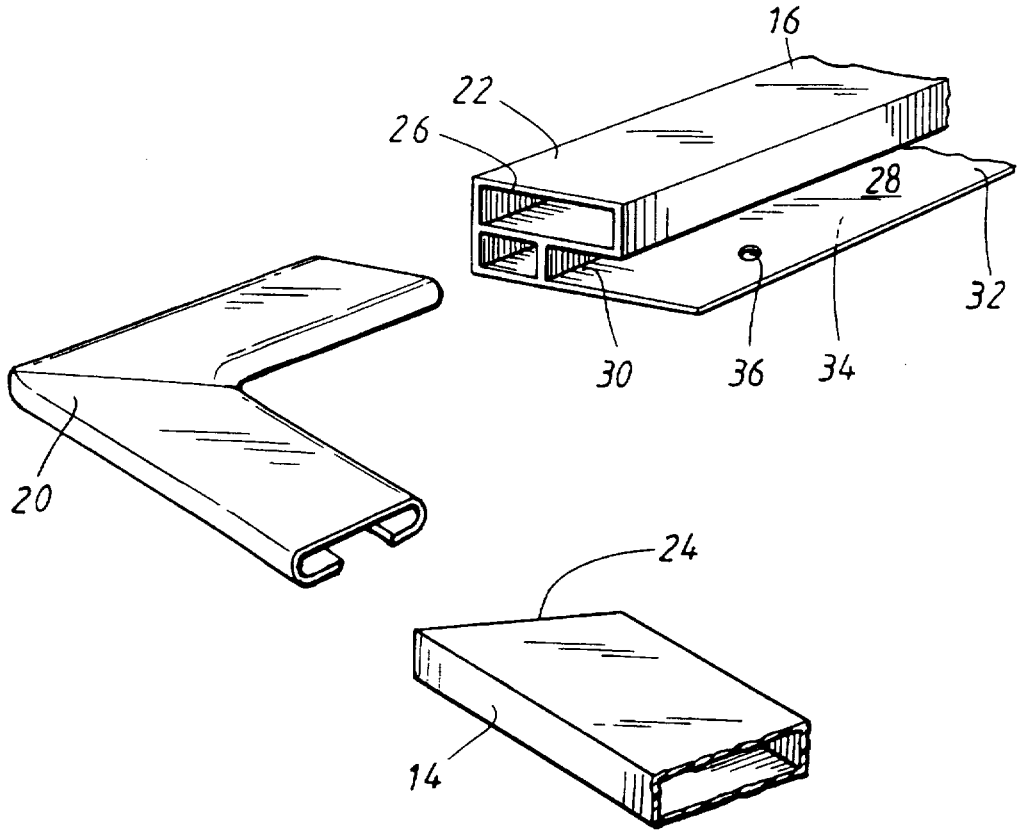
FIG. 2 is a perspective view of parts of the frame according to the invention before assembly of the frame.

The top piece 14 and the side members 16 are connected together as shown in FIG. 2 by means of corner pieces 20. Each corner piece 20 is suitably in the form of an angled resilient metal strip which is adapted to be releasably insertable into adjacent side members 16 and/or top piece 14. To accommodate the corner piece 20, the top piece 14 and a front portion 22 of the side member 16 are in the form of a hollow closed extruded section. The top piece 14 and side members 16 are cut at an angle so that facing edge surfaces 24, 26 of the top piece 14 and side member 16 abut when the frame 10 is assembled.

In addition to the front portion 22, each side member 16 also presents a rear portion 28. The front and rear portions are connected together to form an inwardly facing groove 30. As will become apparent later in the description, this groove is intended to receive edge portions of the poster 18. The rear portion 28 consists of a thin flange having a front surface 32 and a rear surface 34. As is clear from FIG. 2, the front surface 32 of the thin flange partially delimits the groove 30. Furthermore, the thin flange 28 extends beyond the front portion 22 in an inwardly facing direction.

In order to permit the frame 10 to be mounted on the wall 12, the thin flange 28 is provided with means for attaching the frame to the wall. As shown in FIG. 2, the means can comprise one or more holes 36 through which a screw or nail may be introduced. Other suitable means may include adhesive 38 applied to the rear surface 34 of the thin flange 28, a hook and loop type fastener where either the hook or the loop part is attached to the wall and the other to the rear surface of the flange, etc.

Figure 3:
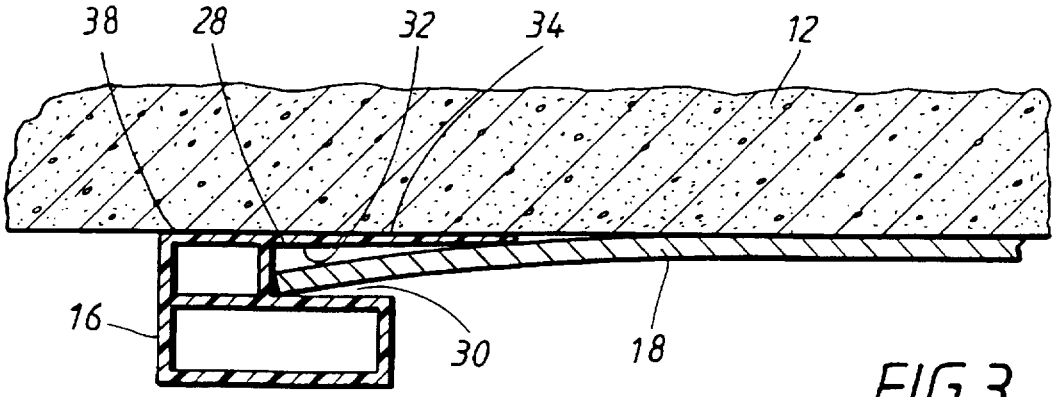
FIG. 3 is a sectional view along line III—III of FIG. 1 on an enlarged scale.

The method for framing a poster in accordance with the present invention will become apparent from FIG. 3. In said figure, the side member 16 is affixed to the section of wall 12 by any of the means mentioned above. In this affixed state, the rear surface 34 of the thin flange 28 of the rear portion of the side member 16 is substantially flat against the wall 12. The poster 18 is introduced into the frame via a gap which will be formed between the top piece 14 (see FIG. 2) and the wall. As mentioned earlier, edge portions of the poster 18 are accommodated by the groove 30. Because of the thinness of the flange 28, when the edge portions of the poster 18 are accommodated in the groove 30, remaining portions of the poster will directly contact the wall 12, as shown in FIG. 3, thus providing support for the poster to thereby retain the edge portions of the poster within the groove 30.

The invention is not restricted to the embodiments described above and shown in the drawings, but may be varied within the scope of the appended claims. For example, the frame may comprise a top piece and two side members to thereby form a triangular-shaped frame. In addition, a rectangular frame may be made up of two top pieces and two side members, with the frame attached to the wall so as to give a diamond-shaped appearance. The through holes 36 in the side members may be slotted to allow the frame to be lifted off screws or nails in the wall without the need to unfasten the screws or remove the nails.

What is claimed is:

1. A frame assembly for framing an article on a wall, said frame assembly comprising:

a top piece;

at least two side members;

a plurality of corner pieces for connecting said top piece and said side members to thereby form an enclosing frame having a through-opening to said wall; and a generally planar sheet-like article, wherein each of said side members presents a front portion and a rear portion, said front portion and said rear portion extending in an inwardly facing direction and being connected together to form an inwardly facing groove therebetween for receiving edge portions of said generally planar sheet-like article while allowing remaining portions of said article to pass through said through-opening and to be supported in direct contact with said wall, said rear portion consisting of a thin planar flange having opposed planar front and rear surfaces with said front surface partially delimiting said groove, said thin planar flange extending beyond said front portion in said inwardly facing direction, said top piece and said front portion of said side members are in the form of a hollow closed extruded section into which said corner pieces project to thereby connect said top piece and said side members to form said enclosing frame.

2. The frame as claimed in claim 1, wherein said thin flange is provided with means for attaching the frame to said wall.

3. The frame as claimed in claim 2, wherein said means for attaching the frame to said wall comprises at least one through hole in said thin flange for the introduction of a screw or nail.

4. The frame as claimed in claim 3, wherein said means for attacking includes an adhesive applied to the rear surface of said thin flange.

5. The frame as claimed in claim 1, wherein said top piece and said side members are made from an extruded plastic material.

6. A method for framing a generally planar sheet-like article in a frame on a wall, said frame comprising a top piece, at least two side members, each of said at least two side members being provided with a groove for receiving edge portions of said poster, and a plurality of corner pieces for connecting said top piece and said side members to thereby form an enclosing frame, said method comprising:

mounting said enclosing frame on said wall using attachment means on said side members, and inserting said article into said enclosing frame so that edge portions of said article are received within said groove and remaining portions of said article directly contact said wall to thereby provide support for said article without the need for a rigid backing sheet.

7. The method as claimed in claim 6, wherein said attachment means comprises a plurality of screws or nails passing through corresponding holes in said side members.

8. The method as claimed in claim 6, wherein said attachment means comprises an adhesive applied to regions of said side members.

9. A frame for framing a generally planar sheet-like article on a wall, said frame comprising:

a) a top piece;

b) at least two side members;

c) a plurality of corner pieces for connecting said top piece and said side members to thereby form an enclosing frame;

wherein each of said side members presents a front portion and a rear portion, said front portion and said rear portion extending in an inwardly facing direction and being connected together to form an inwardly facing groove therebetween for receiving edge portions of said article, said rear portion consisting of a thin planar flange having opposed front and rear surfaces with said front surface partially delimiting said groove, said thin planar flange extending beyond said front portion in said inwardly facing direction, said top piece and said front portion of said side members are in the form of a hollow closed section into which said corner pieces project to thereby connect said top piece and said side members to form said enclosing frame.

* * * * *